United States Patent [19]

Morris, Jr.

[11] 4,129,015

[45] Dec. 12, 1978

[54] ICE STORAGE AND DISPENSING BIN

[76] Inventor: William F. Morris, Jr., P.O. Box 1046, Raleigh, N.C. 27602

[21] Appl. No.: 790,015

[22] Filed: Apr. 22, 1977

[51] Int. Cl.[2] ..... F25C 5/18

[52] U.S. Cl. ..... 62/344; 62/374; 222/236; 366/292; 366/300

[58] Field of Search ..... 62/344, 374; 366/292, 366/297, 300, 318, 320; 222/236

[56] References Cited

U.S. PATENT DOCUMENTS

| | | | |
|---|---|---|---|
| 3,390,537 | 7/1968 | Callen | 62/344 X |
| 3,580,428 | 5/1971 | Garber | 222/236 X |
| 3,793,937 | 2/1974 | Lipoma | 62/374 X |
| 3,913,343 | 10/1975 | Rowland et al. | 62/344 X |
| 3,918,266 | 11/1975 | Gindy et al. | 62/344 X |
| 4,055,053 | 10/1977 | Elfving et al. | 62/344 X |

*Primary Examiner*—William E. Wayner
*Assistant Examiner*—William E. Tapolcai, Jr.
*Attorney, Agent, or Firm*—Mason, Fenwick & Lawrence

[57] ABSTRACT

A cube ice storage and dispensing bin in the form of a large stationary elongated insulated tank of generally cylindrical configuration having a large pool of water therein maintained substantially at water freezing temperature in liquid state. The tank has a pair of longitudinally extending screw conveyor flights, which may be of skeleton-like construction, arranged along axes paralleling the longitudinal center axis of the cylindrical tank and located to opposite sides of the center axis. The screw conveyor flights are journalled in the end walls and driven at a slow speed producing gentle agitation and and tumbling of ice cubes floating in the pool to disrupt tendencies of the ice cubes to form multicube frozen blocks of ice and maintain a slurry of ice cubes and water therein. Transverse conveyor screws are provided adjacent each end for transferring floating ice cubes from an end region of one of the pair of longitudinal flights to the other, and a discharge conveyor having a conveyor screw and a cage-like trough is provided at the discharge end to selectively withdraw ice cubes from the pool of water and discharge them externally of the tank.

26 Claims, 7 Drawing Figures

ICE STORAGE AND DISPENSING BIN

BACKGROUND AND OBJECTS OF THE INVENTION

The present invention relates in general to ice cube storage apparatus, and more particularly to ice storage and dispensing bins for use with automatic ice making equipment to receive cube ice and store large quantities of the ice in a body of water as a slurry of ice and water in an insulated unrefrigerated storage chamber to make large quantities of stored ice cubes available for discharge into bags, receptacles, or ice-utilizing food processing equipment and the like.

Automatic ice making equipment involving reversible cycle refrigeration systems have gone into wide commercial use. In such systems, ice is produced in various forms during the normal refrigeration or freezing phase of the apparatus when condensed liquid refrigerant is evaporated from the evaporator, and the ice is discharged from the evaporator during the defrosting or harvesting phase when hot gaseous refrigerant is delivered directly from the compressor to the evaporator. One type of such reversible cycle ice making equipment produces ice in elongated tubular or annular cylindrical form, with the ice being discharged in such form during the harvesting phase and broken up, in part by impact in the trough portions of the ice making apparatus below the evaporators and also by the transporting screw auger which is conventionally used to convey the ice to a discharge location. The ice may be further broken into desirable sizes by ice breaking and separating machinery of known form.

Also, automatic ice making machines have been available which form large sheets of many interconnected ice cubes on approximately vertical mold surface of a bank of evaporators. At the conclusion of the freezing cycle of the machine, when the sheets or cube ice have been formed on the evaporator mold surfaces, the machine switches to a harvesting cycle wherein hot gaseous refrigerant is admitted to the evaporators to thaw the front bond holding the ice sheets to the evaporators, allowing the ice sheets to fall by gravity into a screw conveyor trough where the ice is transported to a discharge outlet. During the free fall of the ice sheets down the rather narrow passages into the trough, impact of portions of the sheets on parts of the machine and impact of the lower portions on the sheets on the trough and on ice already in the trough causes the ice sheet to break up into random size segments of small numbers of ice cubes in each segment. These small random size segments of small numbers of ice cubes are then further broken up into individual plural ice cubes during transportation of the same to a subsequent processing stage or by passing them through a special separating device which subdivides the small sheets into the individual ice cubes.

In both types of devices, the ice making machines have the capacity of producing large quantities of ice rapidly, and it becomes desirable or necessary in many installations to provide for storage of the ice in some kind of storage receptacle or bin, wherein a large mass of the ice cubes or fragments can be maintained in their separate cube or fragment form during storage and can be withdrawn from the storage facility as desired for packaging or for use. One type of cube or fragment ice storage facility which has been found to have advantages for storing the ice which minimizes mechanical refrigeration requirements is a water basin or chamber type receptacle, having a relatively deep body of water in which the ice is stored in floating condition. However, problems have encountered in reliably harvesting or withdrawing ice from this type of storage facility for all ranges of fill conditions from partially filled to full conditions.

Also, businesses which supply large quantities of bagged cube ice for retail sale in a given market area require great quantities of cube ice, which may be produced by a number of reverse cycle ice making machines of the type previously described, if means are provided to supply the cube ice to a common storage receptacle or bin from which the ice can be withdrawn in appropriate quantities as needed into bagging machines in an efficient and expeditious manner. In such installations, a large storage receptacle or bin is required in which a large mass of the ice cubes or fragments can be maintained in their separate cube or fragment form for the desired storage period and then be withdrawn into the packaging equipment as required. One of the particular problems has been the development of means for storing large quantities of such ice cubes or small ice fragments without their melting or refreezing over relatively long storage periods, without requiring very expensive and complex mechanical refrigeration systems for maintaining temperatures at appropriate levels where the ice can be properly stored.

It is also desirable in installations where ice cubes or fragment ice are needed in processing of foods, such for example in poultry processing lines and the like, to have available a unitary installation capable of producing large quantities of cube ice or fragment ice automatically and storing the ice when it is automatically produced so that it is readily available at all times to supply the food processing lines. It is therefore desirable to have a convenient large storage bin available for cube ice, with which automatic ice making machines can be associated to automatically transport the ice cubes being made by the automatic ice making machines to the storage bin so that a substantial quantity of ice is immediately available for use whenever required in the food processing line.

An object of the present invention, therefore, is the provision of an improved storage and dispensing bin for cube ice, designed to receive and store cube ice or the like produced by automatic ice making machines during the period following production by and discharge of the ice from the ice making machines until its use or packaging is required, wherein the ice cubes are stored in a body of water in a large basin or tank-like chamber as a very large mass of separate ice cubes which are continuously gently disturbed to move through predetermined paths about the storage chamber and are displaced vertically as well as horizontally to avoid lumping tendencies and prevent build up of lumps anywhere in the storage chamber.

Another object of the present invention is the provision of an improved storage and distributing bin for cube ice wherein the cube ice is maintained in floating condition in a fluid mixture or slurry of ice and water in a storage basin or chamber, and in which a plurality of skeleton type tubular screw conveyor devices rotate slowly to continuously gently disturb the ice cubes and displace them vertically and horizontally to disrupt tendencies of the ice cubes to lump together, and wherein the ice cubes are caused to gently migrate toward a discharge station for removal as desired from the storage chamber by a discharge screw mechanism.

Other objects, advantages and capabilities of the present invention will become apparent from the following detailed description, taken in conjunction with the accompanying drawings illustrating a preferred embodiment of the invention.

DETAILED DESCRIPTION OF A PREFERRED EMBODIMENT

Figure 1:
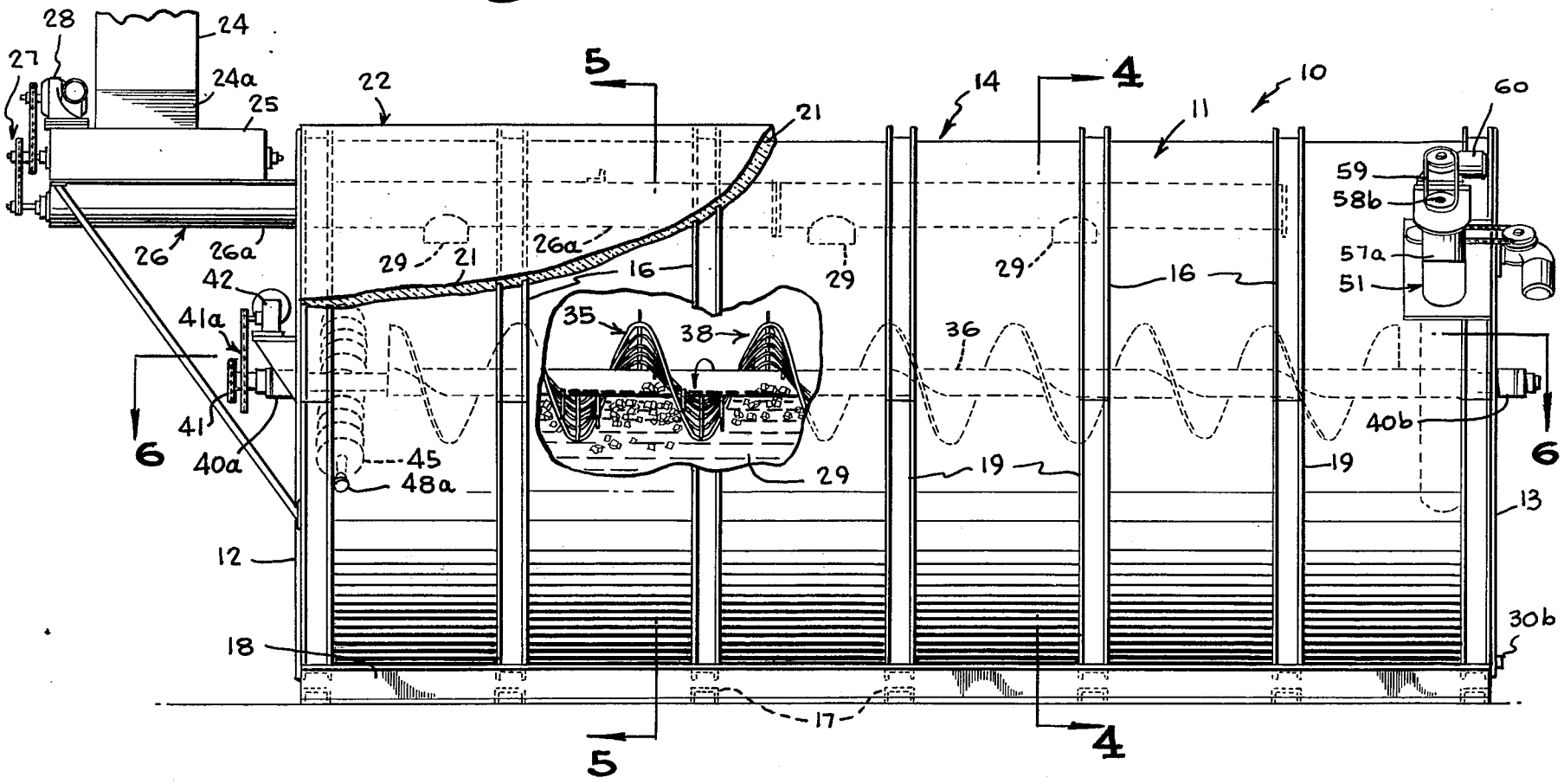
FIG. 1 is an exterior side elevation view of the cube ice storage and dispensing bin of the present invention.
Figure 2:
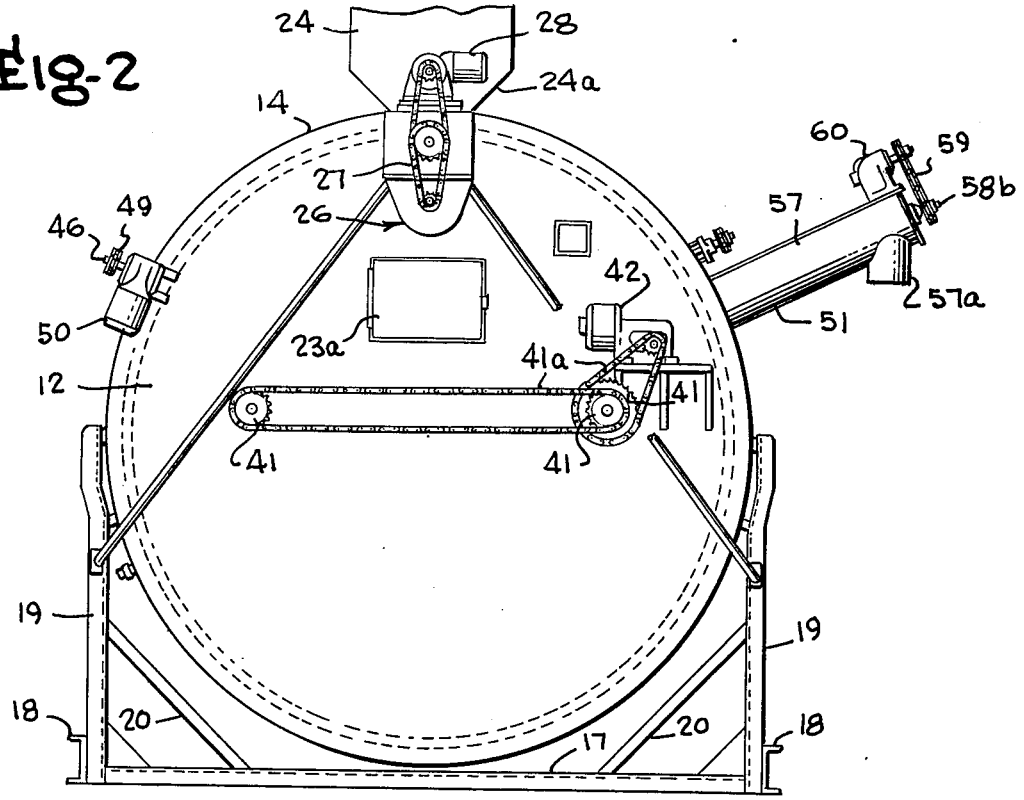
FIG. 2 is an end elevation view thereof, viewed from the drive end or left hand end as viewed in FIG. 1.
Figure 3:
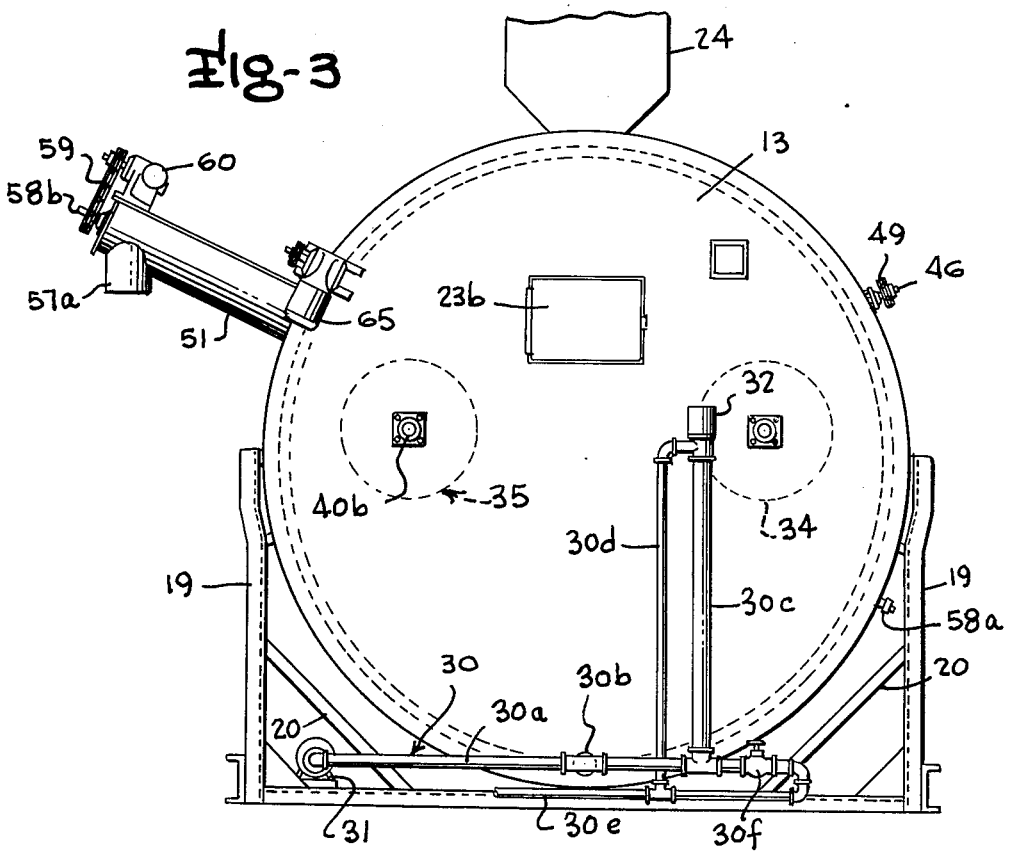
FIG. 3 is an end elevation view of the opposite or idler end thereof.

Referring to the drawings, wherein like reference characters designate corresponding parts throughout the several figures, the cube ice storage and dispensing bin of the present invention is indicated generally by the reference character 10 and comprises a large, axially elongated, cylindrical tank or receptacle 11, which in one illustrated embodiment, may have an axial length of about 24 feet and a diameter of about 12 feet, providing a bin having a storage capacity of about 20,000–30,000 pounds. The tank or receptacle 11 comprises a pair of circular end walls 12 and 13 and a cylindrical side wall 14, preferably formed of stainless steel sheet innerlinings or skins, as indicated at 15, supported by channel iron ring frames 16 of U-shaped or channel cross section spaced, for example, about 48 inches on center and supported on a cradle-like base structure or frame formed of horizontal transverse base frame channel members 17, longitudinal base frame channel members 18 extending along the sides, and upright frame members 19, also of channel shaped cross section, braced by angle bracing pipes 20 and fixed in their upper portions to the channel iron ring frames 16. In this manner, all surfaces which may come in contact with the ice are of stainless steel, meeting the sanitary requirements of the U.S. Department of Agriculture. The stainless steel sheet innerlinings or skins 15 extending about the sides and ends of the cylindrical chamber **11*a* enclosed by side wall 14 and end walls 12, 13 are outwardly covered with a jacket or blanket of insulation material 21, such as foamed urethane or similar foamed insulation of desired thickness, for example, about 3 or 4 inches about the sides and 1 inch or more covering the ends, and this blanket of insulation material is then preferably covered with an outer layer or skin of thin stainless steel sheet material as indicated at 22. Hinged access doors may be provided at any desired locations along the side and end walls above the water level to be established in the storage chamber 11*a*, for example, by providing access doors 23*a* and 23*b* in the upper regions of the opposite end walls 12 and 13**.

In practice, normal installations of such a large capacity cube ice storage and dispensing bin will be arranged in association with an array or bank of automatic cube ice making machines, for example, of the type disclosed in my earlier U.S. Pat. No. 3,766,744 entitled Cube Ice Making Machine And Method, preferably arranged as an array of ice making machines supported on a platform above the level of the ice storage and dispensing bin 10 and arranged to discharge the broken sheets of cube ice delivered from the screw conveyor discharge troughs of such cube ice making machines through a gravity or screw conveyor feed trough underlying the array of cube ice machines and delivering the cube ice discharged therefrom into a common hopper 24. In the illustrated example, the hopper 24 has a generally V-shaped lower portion defined by downwardly converging sides **24*a* narrowing down to a bottom discharge opening which opens into a cube separator 25, similar to the cube separator of my earlier U.S. Pat. No. 3,788,566. The ice inlet conveyor and distributing manifold 26 is formed of a long feed conveyor trough 26*a* which, in the illustrated embodiment, projects about 3½ feet outwardly beyond the end wall 12 of the tank and passes through the upper portion of the end wall 12 and longitudinally along the tank to a location near the opposite end wall, for example, to within about 48 inches of the end wall 13. The feed conveyor trough 26 is preferably of stainless steel sheet metal construction, having a semi-cylindrical lower wall portion concentric with the axis of a conveyor screw 26*b* rotatable within the trough and driven, for example, by a chain and sprocket drive assembly indicated at 27 powered by an electric motor 28 for driving the rotatable component of both the cube separator 25 and the conveyor screw 26*b* of the ice infeed conveyor and manifold 26. In the preferred embodiment, several short discharge outlet tubes, indicated at 29, are spaced axially along the length of the feed conveyor trough 26*a* and open downwardly to discharge the cube ice derived from the bank of automatic cube ice making machines more or less uniformly into the storage chamber 11*a***.

The cylindrical tank 11 of the ice storage and dispensing bin is designed to provide a large pool of water 29 for storage of the cube ice in the cylindrical chamber **11*a* thereof, wherein the ice cubes float in the water, predominantly submerged below the water level maintained in the tank, with the ice cubes floating in water which is maintained in a liquid state at approximately 32° F. by the ice deposited in the pool of water 29. Water is supplied to the tank initially to the desired level, and maintained at the selected water level, for example, about 5 inches below the center of the screws, by a piping system, generally indicated at 30 adjacent the end wall 13 of the tank, including a main suction pipe 30*a* leading to the intake port of a pump 31 which supplies 32° F. water from tank 11 to ice makers as make-up water as required. The pipe 30*a* is connected to a branch pipe 30*b* extending through the tank wall and along the bottom of the tank interior for a suitable distance, having a series of water inlet openings along its length and connected externally of the tank by a tee to the main suction pipe 30*a*. The main suction pipe 30*a* also extends beyond the connection with pipe 30*b* to a tee which joins it to a vertical stand pipe 30*c* extending upwardly to a height slightly above the selected water level. A conventional float switch 32 is associated with the upper end portion of the stand pipe 30*c* to cause make-up water to be supplied to the tank when needed, for example, by introducing city water into the tank near the end 13 in the region below the separating trough 52 where the fines tend to accumulate. An overflow pipe 30***d* connects to the upper end portion of the stand pipe 30*c* and decends to a tee connection with the drain line 30*e* which connects at its upstream end through valve 30*f* with the main suction pipe 30*a*, to discharge overflow water through pipe 30*d* and drain line 30*e* when an overflow condition occurs in the stand pipe 30*c*.

Figure 4:
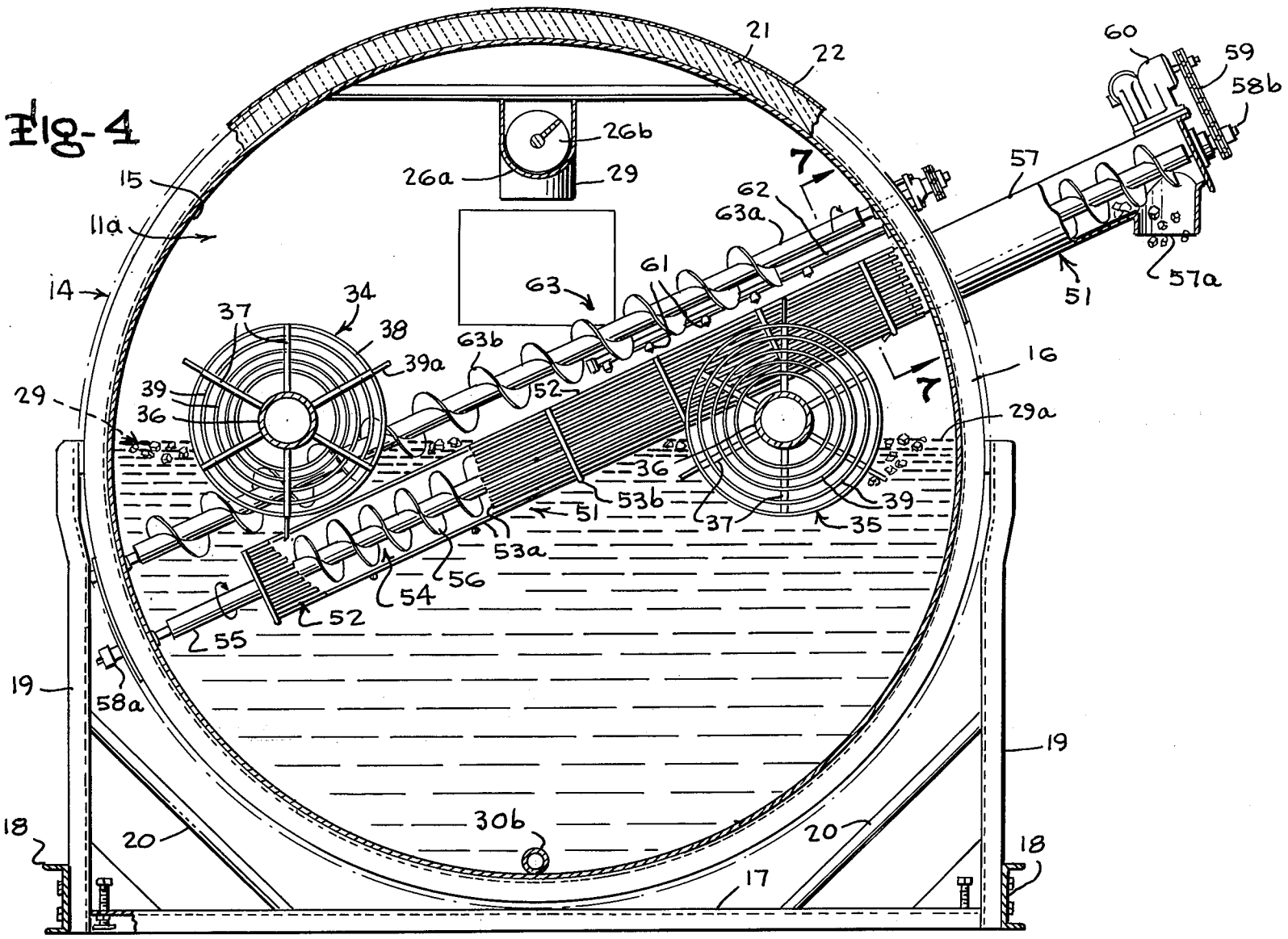
FIG. 4 is a vertical transverse section view taken along the line 4—4 of FIG. 1.
Figures 5, 7:
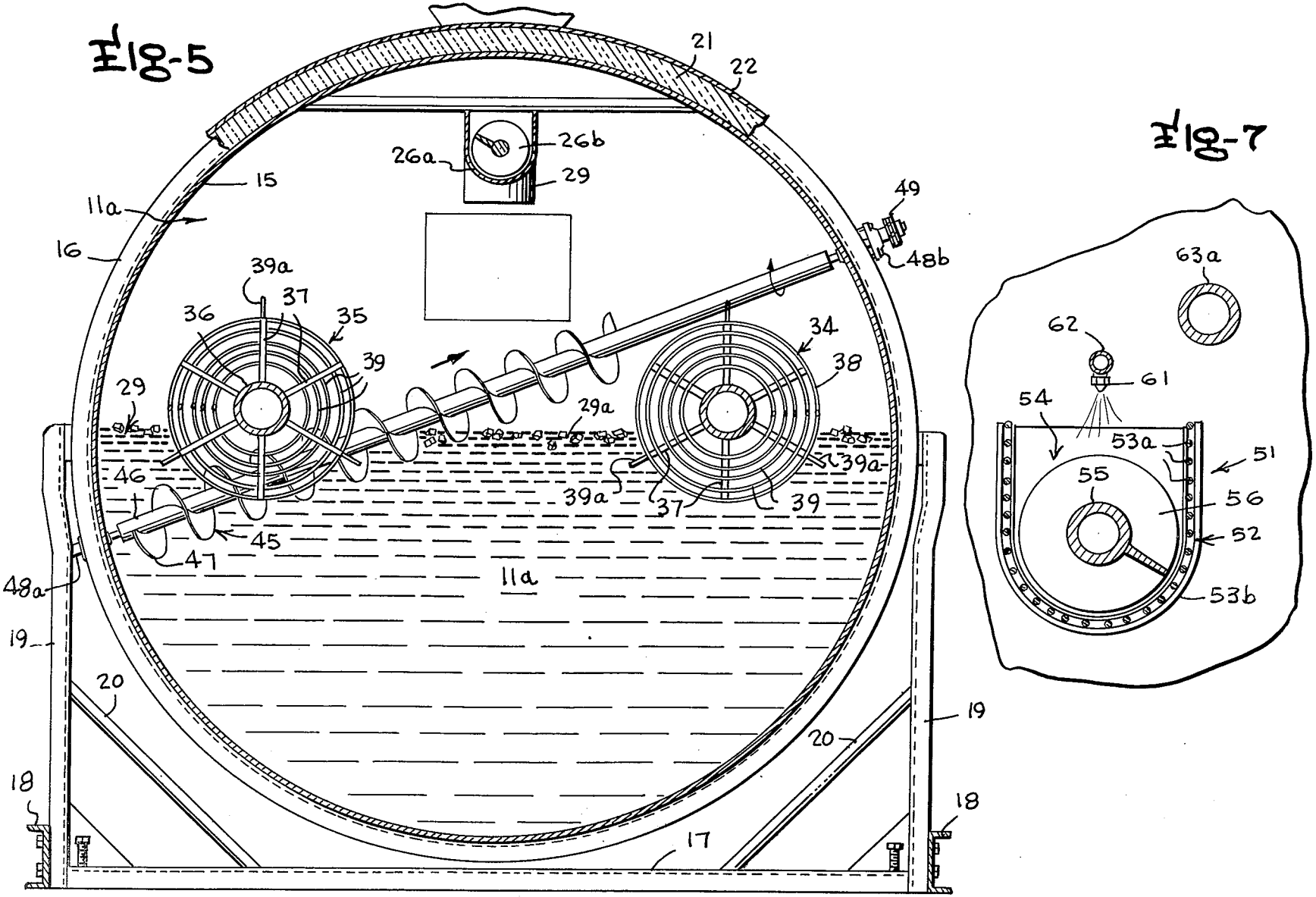
FIG. 5 is a vertical transverse section view taken along the line 5—5 of FIG. 1.
FIG. 7 is a fragmentary section view through the discharge conveyor screw and cage trough, taken along the line 7—7 of FIG. 4.
Figure 6:
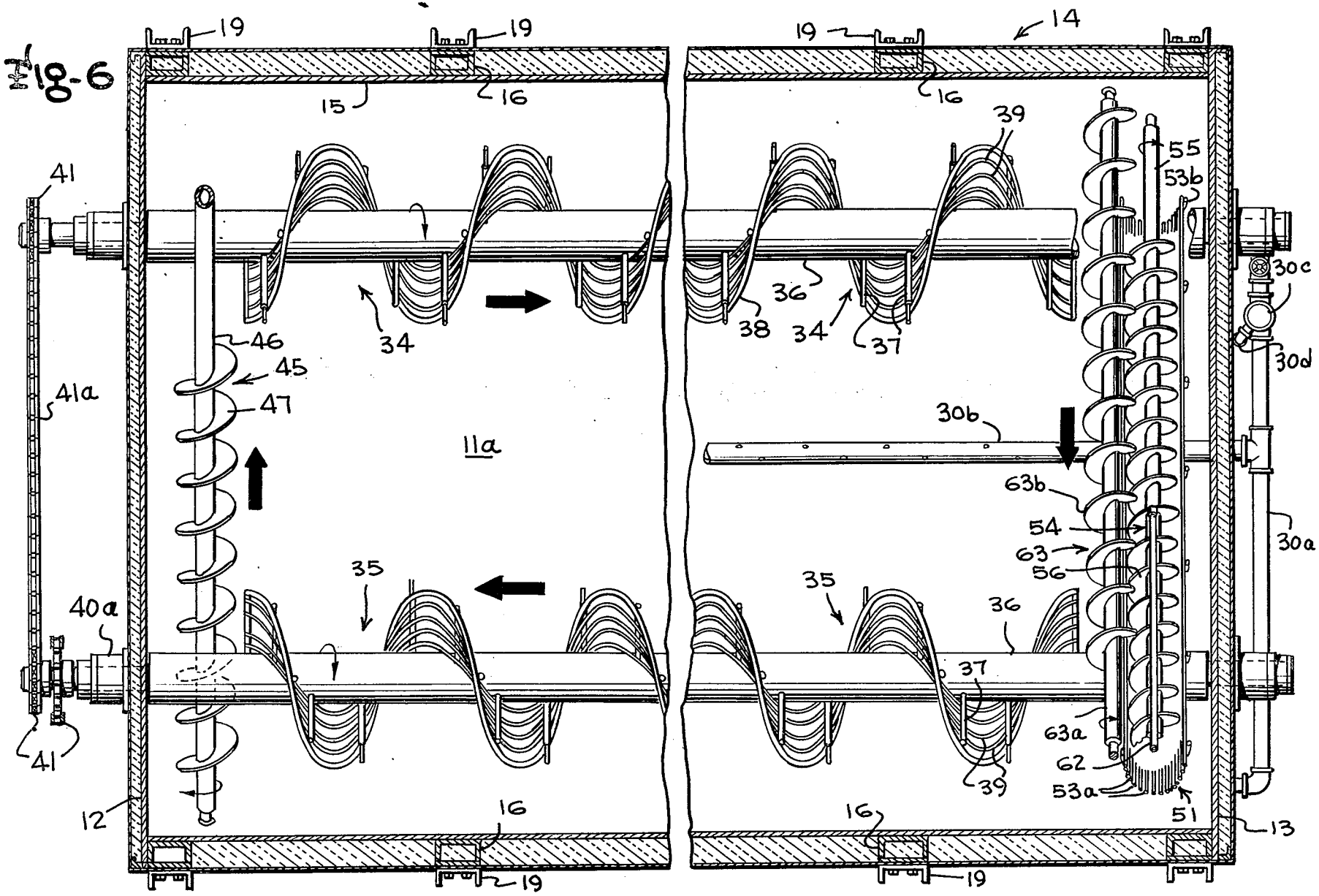
FIG. 6 is a horizontal longitudinal section view taken along the line 6—6 of FIG. 1.

Channeled for rotation in the end wall 12 and 13 with their centers horizontally aligned with the water level 29*a* of the pool of water 29 are a pair of longitudinally extending agitator and harvesting screw conveyor flights 34, 35 having center shafts 36 spanning the length of the tank formed of hollow stainless steel pipe and having stainless steel radial spokes 37 welded thereto and extending from the center shafts providing support for a skeleton type of helical screw conveyor flight formed of a plurality of radially spaced helical rods, for example, stainless steel rods of about ¾ inch diameter, arranged in spiral paths of different diameter concentric with the axis of the center shaft 36 and extending substantially the length of the tank. The helical rods 39 in one example are arranged in cylindrical paths whose radii differ by about 2½ inches and which define a helical flight or screw portion 38 having a maximum diameter of about 2½ feet. The opposite end portions of the center shafts 36 are journaled in sealed bearings 40*a*, 40*b* in the opposite end walls 12, 13 of the tank 11, with the center shafts 36 extending through the drive end 12 and terminating in sprockets 41 intercoupled with each other and with the drive sprocket of a drive motor 42 by a chain drive system 41*a*. The agitator and harvesting spiral conveyors 34, 35, thus form what I call skeleton or cage-like screw conveyor flight portions 38 which extend along a pair of horizontal longitudinal axes paralleling the longitudinal center axis of the cylindrical tank 11. They are spaced symmetrically to opposite sides thereof at suitable locations near the side wall to mildly agitate the ice cubes floating in the body of water 29 to prevent build-up of any lumps of multiple cohered ice cubes and to cause slow migration of the floating ice cubes in the region of the left hand agitating and harvesting conveyor 34, as viewed in FIG. 4, toward the discharge end 13 of the tank and to gently urge the cube ice in the zone of action of the right hand agitating and harvesting screw conveyor 35 toward the drive end wall 12 of the tank.

An inclined transverse screw conveyor flight 45 is provided immediately inwardly of the drive end wall 12, located between the drive end wall 12 and the adjacent ends of the skeleton screw conveyor flights 34, 35, and is inclined, for example, at an angle of about 25° to the horizontal so that the axis of the transverse screw flight 45 passes through the water level 29*a* near the vertical center plane of the tank from a position below the axis of the longitudinal skeleton conveyor flight 35 to a location above the axis of the longitudinal skeleton conveyor flight 34. The transverse screw conveyor flight 45 is formed, for example, of a tubular center shaft 46 having an imperforate helical flight or screw portion 47 welded thereto, both formed of stainless steel, and journaled at the opposite ends of the shaft 46 in bearings 48*a*, 48*b* in the opposite side wall portions of the tank, with a drive sprocket 49 provided on the uppermost end of the center shaft 46 externally of the tank to be coupled by a chain drive system to a suitable electric motor, such as the motor 50. The purpose of the system of parallel longitudinal agitator and harvesting skeleton screw conveyor flights 34 and 35 and the transverse inclined screw conveyor flight 45 at the drive end of the tank is to apply continuously gentle disturbing or moving forces to the ice cubes floating in the pool of water 29 from the skeleton flight portions 38 of the longitudinal conveyors and the flight portion of the transverse conveyor 45 to break up any tendencies of the ice cubes to lump together in cohered or frozen-together multicube masses or lumps and effect gentle, slow migration of the cubes in a flow path about the pool extending longitudinally along one side toward the drive end wall 12, transversely along the drive end wall 12 toward the opposite side, and longitudinally along that opposite side toward the discharge or idler end wall 13, creating what I characterize as a fluid mixture or slurry of ice and water which is continuously gently agitated. Also, the gentle agitating or stirring effect created by the longitudinal skeleton screw conveyor flights 34 and 35 may be enhanced by providing radial extension rods of short length, as indicated at 39*a*, on the outermost rods 39 forming the outer perimeter of the helical flight portion 38. The system of longitudinal screw conveyor flights 34 and 35 and the transverse inclined screw conveyor flight 45 also insure that ice will be continuously urged toward the discharge end during withdrawal of ice cubes from the tank to achieve harvesting of all of the ice from the tank, whether the tank is full of ice or only partially full.

Ice cubes are withdrawn from the tank adjacent the idler or discharge end wall 13 by a cage-type separating trough and discharge screw conveyor assembly, indicated generally by reference character 51. As illustrated in the drawings, the cage-like trough portion, indicated at 52 is of substantially U-shaped transverse cross section formed of straight stringer rods 53*a* and transverse U-shaped rods 53*b* arranged to form an upwardly opening U-shaped cage-like trough whose concave bottom portion is designed to concentrically surround the discharge screw conveyor flight 54 associated therewith. The screw conveyor 54 includes the usual tubular center shaft 55 and helical flight or screw portion 56, both formed of stainless steel, with the discharge screw conveyor 54 arranged along an axis inclining upwardly at a suitable angle, for example, about 25° to 30°, from a position below the end portion of the longitudinal screw conveyor flight 34 to a position above the shaft of the companion longitudinal screw conveyor flight 35, with the discharge screw conveyor flight 54 extending beyond the cylindrical side wall of the tank 11 through a cylindrical or U-shaped imperforate conveyor housing trough portion 57 located externally of the tank. The opposite end portions of the discharge screw conveyor center shaft 55 are journaled in bearings 58*a*, 58*b* located in the tank side wall and the upper end wall of the conveyor housing trough portion 57 with the uppermost end of the center shaft 55 having a sprocket thereon coupled by a chain and sprocket drive 59 with a drive motor 60 operated, for example, from a control console.

The cage-like discharge conveyor trough 52 located within the tank 11 extends from a location below the discharge end portion of the longitudinal screw conveyor 34 in concentric relation to the center shaft of the discharge screw conveyor 54 to the opening in the side wall of the tank through which the screw conveyor 54 passes, with the straight stringer rods 53*a* preferably spaced equal distances apart circumferentially about the curved path defined by the rods in the lower half of the trough and arranged in parallelism with the axis of the conveyor screw shaft 55. In one satisfactory example, the stringer rods 53*a* and U-shaped rods 53*b* may be ½ inch diameter stainless steel rods, and the stringer rods 53*a* may be spaced with their center lines about 2½ inches apart, so that the water, together with the fines and broken pieces of ice, flows freely through the spaces between the stringer rods forming the cage, while the ice cubes which move into the upwardly opening top portion of the cage at and just below the water level when the discharge screw 54 is rotating are carried up the trough defined by the rods and through the housing trough portion 57 to the discharge opening 57*a* of the discharge conveyor where the ice cubes discharge into a bagging machine or other suitable collector for the cube ice. The cube ice being withdrawn through the cage-like trough portion of the discharge conveyor as it passes upwardly along its path of travel out of the water is given an effective washing by a fine spray of water being discharged from spray nozzles 61 located along an elongated spray manifold 62 disposed above the portion of the cage-like trough 52 along the portion of the discharge path immediately after the ice cubes emerge from the storage pool of water 29. Also, an additional inclined ice moving screw 63 is provided immediately above and to one side of the conveyor screw 54 of the discharge conveyor and trough assembly 51, for example substantially centered vertically over a side of the cage trough 52, having an elongated shaft 63*a* and a helical vane or flight 63*b* and disposed in parallelism with the discharge screw 54. The ice moving screw 63 extends to a location below the shaft of spiral conveyor 34 at its lower end and is driven from a drive motor 65. This screw 63 serves the dual purpose of causing transverse fluid flow in the pool at the end 13 and returning to the pool 29 the ice cubes which may tend to pile up above the top level of the cage trough 52 to prevent pile up above the top level of the cage trough 52 to prevent pile up and grinding up of ice cubes in the zone of influence of the discharge conveyor trough 52 which might prevent proper withdrawal of the ice cubes, or give rise to breakage of ice cubes being withdrawn or development of multicube lumps at the discharge zone.

What is claimed is:

1. A cube ice storage and dispensing bin, comprising a large stationary elongated insulated tank defining a closed storage chamber for a large pool of water maintained substantially at water freezing temperature and at a depth such that the water level lies at a suitable level in the tank for storing the ice cubes in floating condition as a large mass of separate ice cubes therein, the tank having opposite feed and discharge transverse ends and longitudinal sides extending therebetween providing an ice storage pool of substantially rectangular plan at the water level, a pair of main screw conveyor flights each having a center shaft journaled in the opposite ends of the tank and a helical vane member extending lengthwise of the tank for moving floating ice cubes in opposite relative directions along first and second longitudinal legs of a circulating loop path inwardly along the sides and ends of the tank, the screw conveyor flights being located at opposite ends of the longitudinal center line of the tank near the sides thereof, transverse ice moving means inwardly adjacent the feed end of the tank for transferring floating ice cubes from an end region of one of said pair of screw conveyor flights to the other, feed means for feeding ice cubes into said tank, discharge conveyor means inwardly adjacent said discharge end for elevating ice cubes from the pool of water at a withdrawal station and conveying them out of the tank to an external discharge station, and means for rotating said screw conveyor flights at a slow speed producing gentle agitation and tumbling of the ice cubes floating in the pool to disrupt tendencies of the ice cubes to form multicube frozen lumps of ice and maintain a fluid slurry of ice cubes and water therein, and said screw conveyor flights and transverse ice moving means being arranged to gently and slowly migrate the floating ice cubes in a predetermined direction along said circulating loop path to pass through said withdrawal station.

2. A cube ice storage and dispensing bin as defined in claim 1, wherein the center axes of said center shafts of the screw conveyor flights are arranged in parallelism with the longitudinal center line of the tank and located a short distance above the vertical mid-point of the tank, and said water level is maintained slightly below the vertical level of said center shafts.

3. A circular ice storage and dispensing bin as defined in claim 1, wherein said tank is a closed cylindrical tank concentric with a horizontal center axis located near said water level and wherein said ends are circular vertical end walls.

4. A cube ice storage and dispensing bin as defined in claim 1, wherein said transverse ice moving means is a rotary driven screw conveyor flight arranged along an axis of rotation transversely spanning the tank and extending from a region at a discharge end of one of said main screw conveyor flights to a location at a feed end of the companion main screw conveyor flight to urge the floating ice cubes transversely from the downstream end of the working zone of the first mentioned screw conveyor flight to the working zone of the second mentioned screw conveyor flight.

5. A cube ice storage and dispensing bin as defined in claim 3, wherein said transverse ice moving means is a rotary driven screw conveyor flight arranged along an axis of rotation transversely spanning the tank and extending from a region at a discharge end of one of said main screw conveyor flights to a location at a feed end of the companion main screw conveyor flight to urge the floating ice cubes transversely from the downstream end of the working zone of the first mentioned screw conveyor flight to the working zone of the second mentioned screw conveyor flight.

6. A cube ice storage and dispensing bin as defined in claim 1, wherein said cube ice feeding means comprises an elongated screw conveyor trough having a rotatably driven screw conveyor flight therein and extending through the feed end wall of the tank above the water level therein through a portion of the length of the tank overlying the center portion of the pool between the two main screw conveyor flights and having a plurality of discharge openings spaced along the length thereof.

7. A cube ice storage and dispensing bin as defined in claim 3, wherein said cube ice feeding means comprises an elongated screw conveyor trough having a rotatably driven screw conveyor flight therein and extending through the feed end wall of the tank above the water level therein through a portion of the length of the tank overlying the center portion of the pool between the two main screw conveyor flights and having a plurality of discharge openings spaced along the length thereof.

8. A cube ice storage and dispensing bin as defined in claim 5, wherein said cube ice feeding means comprises an elongated screw conveyor trough having a rotatably driven screw conveyor flight therein and extending through the feed end wall of the tank above the water level therein through a portion of the length of the tank overlying the center portion of the pool between the two main screw conveyor flights and having a plurality of discharge openings spaced along the length thereof.

9. A cube ice storage and dispensing bin as defined in claim 1, wherein said discharge conveyor means comprising a screw conveyor flight having an elongated center shaft and a helical vane member thereon arranged for rotation along an axis extending transversely of the tank adjacent the discharge end thereof and arranged along a discharge screw axis to extend from said exterior discharge station located outwardly of the tank and above the water level across the tank to a location below the water level and near the end portion of the main screw conveyor flight nearest the opposite side of the tank, said discharge conveyor means further including an elongated trough cage formation formed of a network of plural rigid rods defining a U-shaped screw conveyor trough extending from the location where the discharge screw conveyor flight exits from the tank wall to a predetermined depth below the water level including a plurality of longitudinal rods paralleling the discharge screw conveyor axis spaced apart a distance slightly less than the size of the individual ice cubes to form a separating trough cage through which the water may freely flow but along which the cube ice is conveyed by the discharge screw conveyor flight through an upwardly inclined withdrawal path to said discharge station.

10. A cube ice storage and dispensing bin, comprising a large stationary elongated insulated tank defining a closed storage chamber for a large pool of water maintained substantially at water freezing temperature and at a depth such that the water level lies at a suitable level in the tank for storing the ice cubes in floating condition as a large mass of separate ice cubes therein, the tank having opposite feed and discharge transverse ends and longitudinal sides extending therebetween providing an ice storage pool of substantially rectangular plan at the water level, a pair of skeleton screw conveyor flights each having a center shaft journaled in the opposite ends of the tank and a skeleton helical vane member of open network construction extending lengthwise of the tank for moving floating ice cubes in opposite relative directions along first and second longitudinal legs of a circulating loop path inwardly along the sides and ends of the tank, the screw conveyor flights being located at opposite sides of the longitudinal center line of the tank near the sides thereof, transverse ice moving means inwardly adjacent the feed end of the tank for transferring floating ice cubes from an end region of one of said pair of screw conveyor flights to the other, feed means for feeding ice cubes into said tank, discharge conveyor means inwardly adjacent said discharge end for elevating ice cubes from the pool of water at a withdrawal station and conveying them out of the tank to an external discharge station, and means for rotating said screw conveyor flights at a slow speed producing gentle agitation and tumbling of the ice cubes floating in the pool to disrupt tendencies of the ice cubes to form multicube frozen lumps of ice and maintain a fluid slurry of ice cubes and water therein, and said screw conveyor flights and transverse ice moving means being arranged to gently and slowly migrate the floating ice cubes in a predetermined direction along said circulating loop path to pass through said withdrawal station.

11. A cube ice storage and dispensing bin as defined in claim 10, wherein said skeleton helical vane members of said pair of skeleton screw conveyor flights are each formed of a spiral pattern of circumferentially spaced radial spokes projecting from said center shaft and plural helical rods concentric with said center shaft fixed to said spokes to locate them along spiral paths of different radii providing skeleton vanes having openings for flow of the water in said pool therethrough while preventing passage of the ice cubes therethrough.

12. A cube ice storage and dispensing bin as defined in claim 10, wherein the center axes of said center shafts of the skeleton screw conveyor flights are arranged in parallelism with the longitudinal center line of the tank and located a short distance above the vertical midpoint of the tank, and said water level is maintained slightly below the vertical level of said center shafts.

13. A circular ice storage and dispensing bin as defined in claim 10, wherein said tank is a closed cylindrical tank concentric with a horizontal center axis and wherein said ends are circular vertical end walls.

14. A cube ice storage and dispensing bin as defined in claim 10, wherein said transverse ice moving means is a rotary driven screw conveyor flight arranged along an axis of rotation transversely spanning the tank and extending along an inclined path from a region below the end portion of one of said skeleton screw conveyor flights to a location above the water level near the companion skeleton screw conveyor flight to urge the floating ice cubes transversely from the working zone of the first mentioned skeleton screw conveyor flight to the working zone of the second mentioned skeleton screw conveyor flight.

15. A cube ice storage and dispensing bin as defined in claim 12, wherein said transverse ice moving means is a rotary driven screw conveyor flight arranged along an axis of rotation transversely spanning the tank and extending along an inclined path from a region below the end portion of one of said skeleton screw conveyor flights to a location above the water level near the companion skeleton screw conveyor flight to urge the floating ice cubes transversely from the working zone of the first mentioned skeleton screw conveyor flight to the working zone of the second mentioned skeleton screw conveyor flight.

16. A cube ice storage and dispensing bin as defined in claim 13, wherein said transverse ice moving means is a rotary driven screw conveyor flight arranged along an axis of rotation transversely spanning the tank and extending along an inclined path from a region below the end portion of one of said skeleton screw conveyor flights to a location above the water level near the companion skeleton screw conveyor flight to urge the floating ice cubes transversely from the working zone of the first mentioned skeleton screw conveyor flight to the working zone of the second mentioned skeleton screw conveyor flight.

17. A cube ice storage and dispensing bin as defined in claim 11, wherein said transverse ice moving means is a rotary driven screw conveyor flight arranged along an axis of rotation transversely spanning the tank and extending along an inclined path from a region below the end portion of one of said skeleton screw conveyor flights to a location above the water level near the companion skeleton screw conveyor flight to urge the floating ice cubes transversely from the working zone of the first mentioned skeleton screw conveyor flight to the working zone of the second mentioned skeleton screw conveyor flight.

18. A cube ice storage and dispensing bin as defined in claim 10, wherein said cube ice feeding means comprises an elongated screw conveyor trough having a rotatably driven screw conveyor flight therein and extending through the feed end wall of the tank above the water level therein through a portion of the length of the tank overlying the center portion of the pool between the two skeleton screw conveyor flights and having a plurality of discharge openings spaced along the length thereof.

19. A cube ice storage and dispensing bin as defined in claim 12, wherein said cube ice feeding means comprises an elongated screw conveyor trough having a rotatably driven screw conveyor flight therein and extending through the feed end wall of the tank above the water level therein through a portion of the length of the tank overlying the center portion of the pool between the two skeleton screw conveyor flights and having a plurality of discharge openings spaced along the length thereof.

20. A cube ice storage and dispensing bin as defined in claim 10, wherein said discharge conveyor means comprising a screw conveyor flight having an elongated center shaft and a helical vane member thereon arranged for rotation along an axis extending transversely of the tank adjacent the discharge end thereof and arranged along a discharge screw axis to extend from said exterior discharge station located outwardly of the tank and above the water level across the tank to a location below the water level and near the end portion of the skeleton screw conveyor flight nearest the opposite side of the tank, said discharge conveyor means further including an elongated trough cage formation formed of a network of plural rigid rods defining a U-shaped screw conveyor trough extending from the location where the screw conveyor flight exits from the tank wall to a predetermined depth below the water level including a plurality of longitudinal rods paralleling the discharge screw conveyor axis spaced apart a distance slightly less than the size of the individual ice cubes to form a separating trough cage through which the water may freely flow but along which the cube ice is conveyed by the discharge screw conveyor flight through an upwardly inclined withdrawal path to said discharge station.

21. A cube ice storage and dispensing bin as defined in claim 12, wherein said discharge conveyor means comprising a screw conveyor flight having an elongated center shaft and a helical vane member thereon arranged for rotation along an axis extending transversely of the tank adjacent the discharge end thereof and arranged along a discharge screw axis to extend from said exterior discharge station located outwardly of the tank and above the water level across the tank to a location below the water level and near the end portion of the skeleton screw conveyor flight nearest the opposite side of the tank, said discharge conveyor means further including an elongated trough cage formation formed of a network of plural rigid rods defining a U-shaped screw conveyor trough extending from the location where the screw conveyor flight exits from the tank wall to a predetermined depth below the water level including a plurality of longitudinal rods paralleling the discharge screw conveyor axis spaced apart a distance slightly less than the size of the individual ice cubes to form a separating trough cage through which the water may freely flow but along which the cube ice is conveyed by the discharge screw conveyor flight through an upwardly inclined withdrawal path to said discharge station.

22. A cube ice storage and dispensing bin as defined in claim 18, wherein said discharge conveyor means comprising a screw conveyor flight having an elongated center shaft and a helical vane member thereon arranged for rotation along an axis extending transversely of the tank adjacent the discharge end thereof and arranged along a discharge screw axis to extend from said exterior discharge station located outwardly of the tank and above the water level across the tank to a location below the water level and near the end portion of the skeleton screw conveyor flight nearest the opposite side of the tank, said discharge conveyor means further including an elongated trough cage formation formed of a network of plural rigid rods defining a U-shaped screw conveyor trough extending from the location where the screw conveyor flight exits from the tank wall to a predetermined depth below the water level including a plurality of longitudinal rods paralleling the discharge screw conveyor axis spaced apart a distance slightly less than the size of the individual ice cubes to form a separating trough cage through which the water may freely flow but along which the cube ice is conveyed by the discharge screw conveyor flight through an upwardly inclined withdrawal path to said discharge station.

23. A cube ice storage and dispensing bin as defined in claim 14, including an additional pile-up preventing conveyor screw flight arranged along an axis paralleling the axis of the discharge conveyor screw flight and located immediately adjacent and above the side of said trough cage nearest the discharge end wall of the tank and spanning the major portion of the length of said trough cage located above the water level to dislodge from above the trough cage and return to the pool of water ice cubes which reach predetermined levels above the top of the trough cage.

24. A cube ice storage and dispensing bin as defined in claim 20, including an additional pile-up preventing conveyor screw flight arranged along an axis paralleling the axis of the discharge conveyor screw flight and located immediately adjacent and above the side of said trough cage nearest the discharge end wall of the tank and spanning the major portion of the length of said trough cage located above the water level to dislodge from above the trough cage and return to the pool of water ice cubes which reach predetermined levels above the top of the trough cage.

25. A cube ice storage and dispensing bin as defined in claim 21, including an additional pile-up preventing conveyor screw flight arranged along an axis paralleling the axis of the discharge conveyor screw flight and located immediately adjacent and above the side of said trough cage nearest the discharge end wall of the tank and spanning the major portion of the length of said trough cage located above the water level to dislodge from above the trough cage and return to the pool of water ice cubes which reach predetermined levels above the top of the trough cage.

26. A cube ice storage and dispensing bin as defined in claim 18, including an additional pile-up preventing conveyor screw flight arranged along an axis paralleling the axis of the discharge conveyor screw flight and located immediately adjacent and above the side of said trough cage nearest the discharge end wall of the tank and spanning the major portion of the length of said trough cage located above the water level to dislodge from above the trough cage and return to the pool of water ice cubes which reach predetermined levels above the top of the trough cage.

* * * * *